US006286439B1

(12) United States Patent
Dias

(10) Patent No.: US 6,286,439 B1
(45) Date of Patent: Sep. 11, 2001

(54) SIDE SUPPORT FOR A HANGING STORAGE UNIT

(76) Inventor: Gary R. Dias, 309 Euer Ct., Folsom, CA (US) 95630

( * ) Notice: Subject to any disclaimer, the term of this patent is extended or adjusted under 35 U.S.C. 154(b) by 0 days.

(21) Appl. No.: 09/296,214

(22) Filed: Apr. 20, 1999

(51) Int. Cl.[7] ..... A47B 23/00
(52) U.S. Cl. ..... 108/42; 108/108
(58) Field of Search ..... 108/42, 106, 108, 108/107; 240/235, 250; 312/408, 351, 245, 246, 247; 52/36.4, 36.5; 211/187

(56) References Cited

U.S. PATENT DOCUMENTS 4,040,588 * 8/1977 Papsco et al. ..... 108/108 X
4,984,759 * 1/1991 Perlant ..... 108/108 X
5,097,771 * 3/1992 James, III ..... 108/42
5,233,930 * 8/1993 Wang ..... 108/42
5,405,114 * 4/1995 Dias ..... 108/108 X
5,429,433 * 7/1995 Bird et al. ..... 211/187 X
5,623,882 * 4/1997 Price ..... 108/161 X
5,706,737 * 1/1998 Whitehead et al. ..... 108/42
5,921,190 * 7/1999 Wood ..... 108/106 X
6,019,331 * 2/2000 Hoogland et al. ..... 108/108 X

* cited by examiner

*Primary Examiner*—Jose V. Chen
(74) *Attorney, Agent, or Firm*—Fish & Richardson P.C.

(57) ABSTRACT

A side support for a hanging storage unit includes a rigid panel formed from either a molded polymer-based material or a cast metallic material. A mounting element, such as a mounting bracket, is embedded in and protrudes from the rigid panel to allow hanging of the side support from a support structure.

16 Claims, 2 Drawing Sheets

SIDE SUPPORT FOR A HANGING STORAGE UNIT

TECHNOLOGICAL FIELD

The invention relates to supporting hanging furniture and, in particular, to the design and fabrication of a side support for a hanging storage unit, such as a bookshelf, a file cabinet, a file bin, or the like.

BACKGROUND

Many types of furniture, such as modular office furniture, include hanging storage units that are designed specifically to preserve floor and desk space. These storage units include bookshelves, file cabinets, file bins, and the like that typically hang from fixed walls or wall partitions and from standing pieces of furniture. Hanging storage units usually are supported by brackets mounted to the side panels of the storage units. These brackets interlock with a support structure in the wall or the standing furniture.

For many hanging storage units, the side panels or side supports are constructed from particleboard or plywood that is coated with a decorative paper or material, such as FORMICA, paint, or the like. As a result, the storage units are relatively heavy and, to many people, unattractive. The storage units also tend to develop unsightly defects over time, especially as the decorative material chips away, exposing the particleboard or plywood underneath.

Producing side supports for this type of storage unit is both labor and resource intensive. First the particle board or plywood is pre-sanded and processed to remove any surface defects. Then the particle board or plywood is processed to add adhesive for laminate or decorative skins. Some particle board products include paper skins built into the manufacturing of the raw material. In general, the fabrication processes for the large raw stock sheets include hours of high pressure press time to laminate and cure the raw sheet stock sizes. These raw sheet stock sizes vary approximately from 4'×8' and larger. The particle board or plywood is then cut to size for the smaller raw side panel support sizes. The smaller raw side panel supports are then drilled or routed to accommodate mounting brackets and other mounting components, such as mounting inserts, T-molding, or the like. Some manufacturers route edge shapes onto the side panels and use a lengthy process to paint the edges, which then must be allowed to dry. These applications involve high material costs and rely heavily on human labor, which further increases costs and reduces quality control in producing these types of supports.

In some modular office systems, side supports are formed from sheets of metal or from metal rods that are bent and then welded to form flat plates or hollow frames. In most cases, additional welding of other attaching components or other metal shapes is required to finish the fabricated side panel support. A coat of paint is then applied. The painting process for metal is extensive since the metal must undergo washing, drying, painting, and then baking to solidify the paint. This process is usually carried out in a large, expensive paint booth or tunnel.

Like particleboard or plywood supports, metal supports tend to develop unsightly blemishes as the paint chips and wears over time. Also, over time the mounting brackets tend to pull away from both plywood and metal supports under heavy loads, thus compromising the structural integrity of the supports.

SUMMARY

The inventor has developed side supports for hanging storage units that are more lightweight, more reliable, more aesthetically pleasing, and easier to manufacture than conventional supports. These side supports are formed from materials that can be molded or cast, such as polymer-based materials or lightweight metals and metal alloys. In general, molding and casting techniques allow the side supports to be formed in any color and with virtually any shape and thickness. Molding and casting techniques also allow easy formation of patterns, images, and textures in the side supports. Moreover, molding and casting techniques allow the manufacturer to embed mounting elements and even rigid frames in the side supports during the molding or casting process. No T-molding, screws, or adhesives are needed to affix the mounting elements to the supports.

In one aspect, the invention features a side support for a hanging storage unit. The support includes a rigid panel formed from either a molded polymer-based material or a cast metallic material. A mounting element is embedded in and protrudes from the rigid panel to allow hanging of the side support from a support structure.

In some embodiments, a raised web-like or grid-like pattern is formed on one surface of the rigid panel to improve the strength of the side support. Some of these embodiments include two molded pieces that are bonded together. Other embodiments include mounting elements that are formed from the same polymer-based or metallic material as the rigid panels. In other embodiments, the rigid panel includes at least one attachment element, such as a recess or a cantilevered stud, that allows the side support to attach to another component of the hanging storage unit.

In another aspect, the invention involves the fabrication of a rigid side support for a hanging storage unit. The support is formed by placing a mounting element into a mold that defines the shape of the side support and then injecting a liquefied polymer-based or metallic material into the mold to surround a portion of the mounting element. The polymer-based or metallic material solidifies around the mounting element to form the rigid support. In some embodiments, a rigid frame is placed into the mold before the polymer-based or metallic material is injected into the mold. An alternative fabrication technique involves the use of a mold that forms a mounting element, such as a wall-hanging element, from the same polymer-based or metallic material used to form the side support.

In yet another aspect, the invention features a hanging storage structure that includes two side supports and a horizontal support shelf. Each of the side supports is formed from a molded polymer-based material or a cast metallic material, and each includes at least one embedded mounting element. The horizontal support element connects between the two side supports to allow storage of items such as books and boxes when the unit is hanging.

Other embodiments and advantages will become apparent from the following description and from the claims.

DETAILED DESCRIPTION

Figure 1:
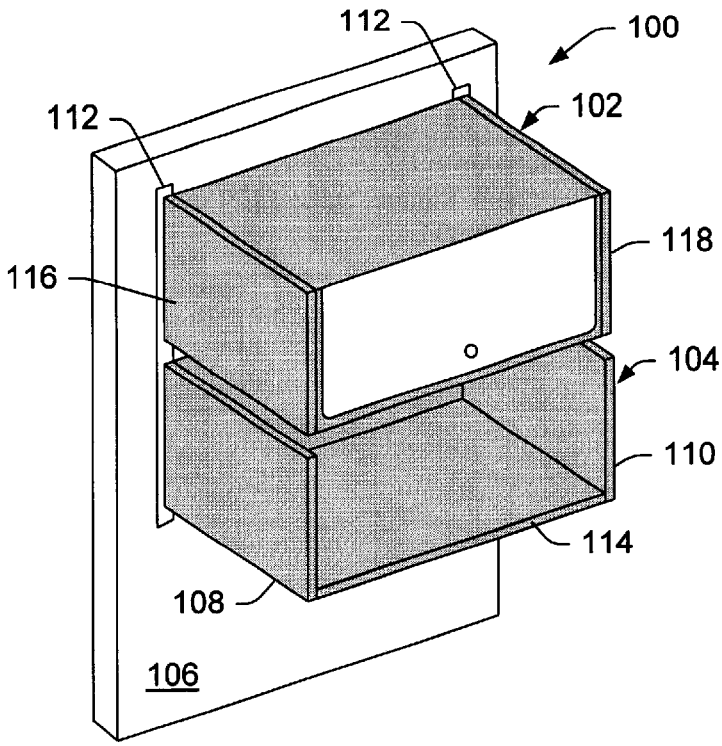
FIG. 1 is a perspective view of two hanging storage units, such as a bookshelf and a file cabinet or file bin, hanging from a rigid support structure.

FIG. 1 shows a modular furniture system 100 in which two storage units, such as a file bin or file cabinet 102 and a bookshelf 104, hang from a rigid support structure 106, such as a wall or a piece of furniture. The bookshelf 104 includes two side supports 108, 110 that attach to one or more mounting brackets 112 affixed to the rigid support structure 106. A horizontal support shelf 114 extends between the two side supports 108, 110 to provide storage space when the shelf 104 is hanging.

Like the bookshelf 104, the file cabinet 102 includes two side supports 116, 118 that attach to the mounting brackets 112. The side supports must be strong enough that the storage units can support relatively heavy loads. For example, one standard put forth by Underwriters Laboratories Inc. (UL), known as the "UL 1286" standard, requires a minimum support load of five (5) pounds per lineal inch of shelf space. Shelves or storage units in this capacity are typically 58" to 60" in length and therefore must carry a minimum load of 290 to 300 pounds to satisfy the UL 1286 standard.

Figure 2:
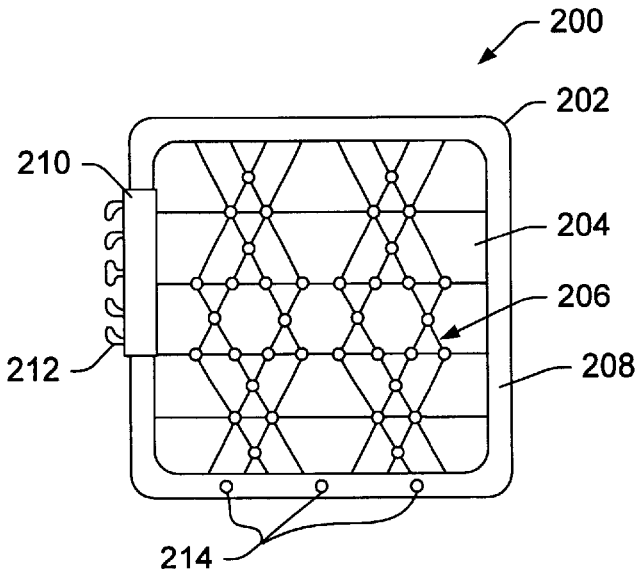
FIG. 2 is cross-sectional view of a side support for the storage units of FIG. 1.

FIG. 2 shows one design for a side support 200 that is strong enough to support heavy loads and that is lighter in weight, more aesthetically pleasing, and easier to produce than conventional side supports. This support 200 includes a single, rigid panel 202 formed from a molded or cast material, such as a polymer-based resin or a lightweight metal or metal alloy. Materials such as molded plastics and cast aluminum are particularly useful in forming the rigid panel 202. In general, these side supports are approximately half as heavy as similar-sized particleboard supports. Molded and cast supports also maintain their aesthetic appeal, even after receiving dents and scratches, because the materials used to form these supports have uniform structure and appearance throughout the thickness of the supports.

In many cases, the rigid panel 202 includes a cavity 204 into which a raised web-like or grid-like pattern 206 is formed. The cavity is surrounded by a wall 208 that defines the thickness of the rigid panel 202. The raised pattern 206 and the wall 208 together increase the structural integrity of the rigid panel 202, which allows the side support 200 to withstand greater loads.

The side support 200 also includes one or more mounting elements 210 that are embedded in the rigid panel 202 during the molding or casting process. The mounting element 210 usually includes an interlocking mechanism, such as a set of teeth 212 or a spring-loaded clasp, that securely attaches the side support 200 to the rigid structure from which it hangs. In many cases, the mounting element 210 is an off-the-shelf steel bracket that is securely embedded in the rigid panel 202 during the molding or casting process. In other embodiments, the mounting element 210 is formed from the same material as the rigid panel 202 during the molding or casting process. One design for the mounting element, like that shown in FIG. 2, allows the side support to be used interchangeably on either the right or left side of the hanging storage unit. The side support 200 also includes one or more elements 212, such as screw holes, recesses, or cantilevered studs, that allow the side support 200 to attach to other components, such as the horizontal support shelf 114 of FIG. 1.

Figure 3:
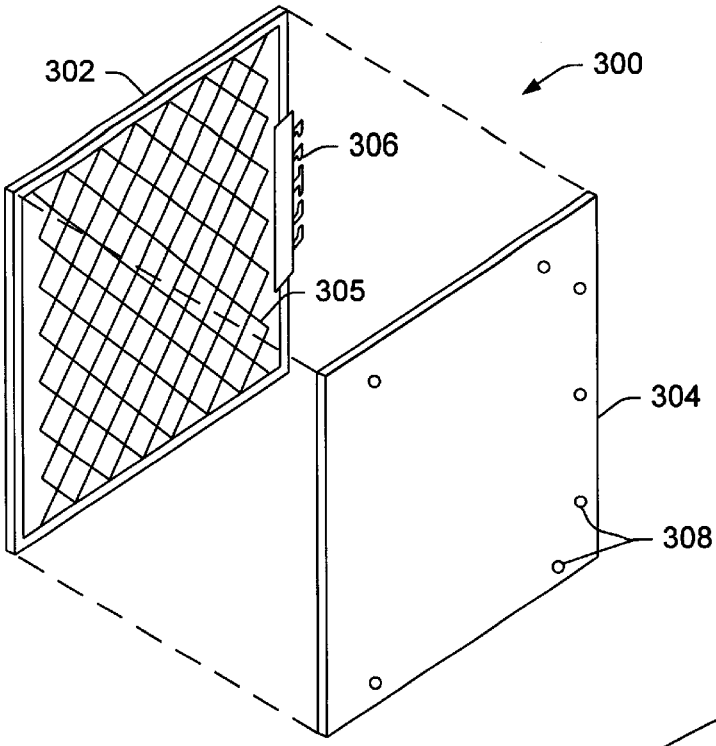
FIG. 3 is an exploded view of another side support for the storage units of FIG. 1.

FIG. 3 shows a side support 300 formed by bonding two molded or cast panels 302, 304. Techniques for bonding the rigid panels 302, 304 include sonic welding and the application of a strong adhesive compound. Bonding two panels in this manner enhances the appearance of the side support 300 by concealing the raised web-like structure 305 that is formed on one or both of the panels 302, 304. In many cases, bonding two panels also increases the strength of the side support 300, thereby increasing the support's ability to withstand heavy loads. In general, only one of the panels 302, 304 includes an embedded mounting element 306, although in some applications both panels include these elements. In general, one or both of the panels also includes elements 308, such as recesses or cantilevered studs, that allow the side support 300 to connect to other components.

Figure 4:
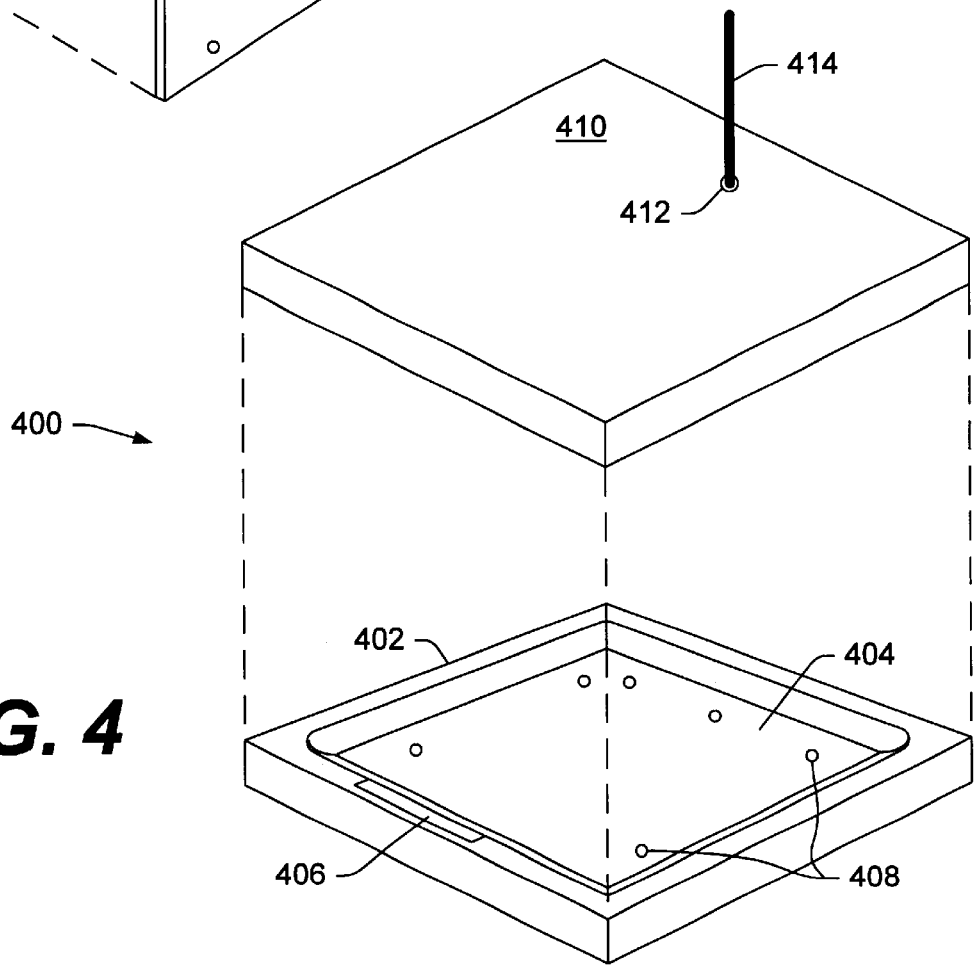
FIG. 4 is a perspective view of a mold, such as an injection mold or a cast mold, for use in making the side supports of FIGS. 2 and 3.

FIG. 4 shows an injection mold or casting mold 400 used to produce a side support like those described above. The mold 400 includes a base portion 402 having a cavity 404 that defines the shape of the side support. The cavity 404 includes a receptacle 406 that holds the mounting element in place during the molding or casting process. Alternatively, if the mounting element is to be formed from the same material as the rigid panel, the cavity 404 itself includes a portion that is shaped to produce the mounting elements. The base portion 402 of the mold 400 also includes features 408, such as recesses or protruding studs, which form the holes or cantilevered studs that allow the side support to attach to other components.

The mold 400 also includes a lid portion 410 that rests securely on the base portion 402 during the molding or casting process. Like the base portion 402, the lid portion 404 usually includes a cavity that helps define the shape of the side support. If the side support is to include a raised, web-like structure, the mold for this structure is formed in the lid portion 410. The lid portion also includes an injection port 412, to which an injection tube 414 connects. The injection tube 414 delivers a liquefied polymer-based or metallic material into the mold 400. The material solidifies in the mold to form the rigid side support.

A number of embodiments of the invention are described above. Nevertheless, various modifications can be made without departing from the spirit and scope of the invention. For example, some side supports include internal frames embedded in the molded or cast material to increase the strength and structural integrity of the supports. Also, techniques other than the injection molding technique described above are used to produce some side supports. For example, in one technique, known as "blow molding," a rigid frame is placed into the mold and a foamy, polymer-based material fills in around the frame. The polymer-based material remains slightly softened, or semi-rigid, even after solidifying. Blow molding produces side supports that are comparable in both weight and strength to the patterned supports described above without the need for forming patterns on the supports. Accordingly, other embodiments are within the scope of the following claims.

What is claimed is:

1. A side support for a hanging storage unit comprising:

a rigid panel formed from a molded polymer-based material, said rigid panel having first and second parallel sides; and a mounting element comprising a plate-like bracket having first and second parallel sides and a plurality of attachment elements to allow hanging of the side support, said plate-like bracket having at least a portion molded into the rigid panel such that said first and second sides of the plate-like bracket are parallel to the first and second sides of the rigid panel.

2. The support of claim 1, further comprising a raised pattern formed on one surface of the rigid panel.

3. The support of claim 1, wherein the mounting element is formed from the same polymer-based material as the rigid panel.

4. The support of claim 1, wherein the rigid panel includes two molded pieces that are bonded together.

5. The support of claim 1, wherein the rigid panel includes at least one attachment element to attach the side support to another component of the hanging storage unit.

6. The support of claim 1, wherein the rigid panel has a substantially rectangular shape.

7. A side support for a hanging storage unit comprising:

a rigid panel formed from a cast metal or metal alloy material, said rigid panel having first and second parallel sides; and a mounting element comprising a plate-like bracket having first and second parallel sides and plurality of attachment elements to allow hanging of the side support, said plate-like bracket having at least a portion cast into the rigid panel such that said first and second sides of the plate-like bracket are parallel to the first and second sides of the rigid panel.

8. The support of claim 7, further comprising a raised pattern formed on one surface of the rigid panel.

9. The support of claim 7, wherein the mounting element is formed from the same metal of metal alloy material as the rigid panel.

10. The support of claim 7, wherein the rigid panel includes two cast pieces that are bonded together.

11. The support of claim 7, wherein the rigid panel includes at least one attachment element to attach the side support to another component of the hanging storage unit.

12. The support of claim 7, wherein the rigid panel has a substantially rectangular shape.

13. The hanging storage structure of claim 12, wherein each of the first and second planar side supports has a substantially rectangular shape.

14. A hanging storage unit comprising:

a first planar side support including a rigid panel formed from a molded, polymer-based material, said rigid panel having first and second parallel sides; and a mounting element comprising a plate-like bracket having first and second parallel sides and a plurality of attachment elements to allow hanging of the side support, said plate-like bracket having at least a portion molded into the rigid panel such that said first and second sides of the plate-like bracket are parallel to the first and second sides of the rigid panel;

a second planar side support including a rigid panel formed from a molded, polymer-based material, said rigid panel having first and second parallel sides; and a mounting element comprising a plate-like bracket having first and second parallel sides and a plurality of attachment elements to allow hanging of the side support, said plate-like bracket having at least a portion molded into the rigid panel such that said first and second sides of the plate-like bracket are parallel to the first and second sides of the rigid panel; and at least one horizontal support element connected between the first and second planar side supports to allow storage when hanging.

15. A hanging storage structure comprising:

a first planar side support including a rigid panel formed from a cast, lightweight metal or metal alloy material, said rigid panel having first and second parallel sides; and a mounting element comprising a plate-like bracket having first and second parallel sides and a plurality of attachment elements to allow hanging of the side support, said plate-like bracket having at least a portion cast into the rigid panel such that said first and second sides of the plate-like bracket are parallel to the first and second sides of the rigid panel;

a second planar side support including a rigid panel formed from a cast, lightweight metal or metal alloy material, said rigid panel having first and second parallel sides; and a mounting element comprising a plate-like bracket having first and second parallel sides and a plurality of attachment elements to allow hanging of the side support, said plate-like bracket having at least a portion cast into the rigid panel such that said first and second sides of the plate-like bracket are parallel to the first and second sides of the rigid panel; and at least one horizontal support element connected between the first and second planar side supports to allow storage when hanging.

16. The hanging storage structure of claim 15, wherein each of the first and second planar side supports has a substantially rectangular shape.

* * * * *